United States Patent [19]

Tanel

[11] Patent Number: 5,058,292

[45] Date of Patent: Oct. 22, 1991

[54] CLEAT FOR AN ATHLETIC SHOE

[75] Inventor: Michael L. Tanel, Milwaukee, Wis.

[73] Assignee: Tanel Corporation, Milwaukee, Wis.

[21] Appl. No.: 407,620

[22] Filed: Sep. 15, 1989

[51] Int. Cl.[5] ..... A43B 5/00; A43C 15/02

[52] U.S. Cl. ..... 36/126; 36/67 R

[58] Field of Search ..... 36/134, 67 R, 67 A, 36/126, 128, 59 R

[56] References Cited

U.S. PATENT DOCUMENTS

| | | | |
|---|---|---|---|
| Re. 26,419 | 7/1968 | McAuliffe | 36/128 |
| D. 171,130 | 12/1953 | Gruner | D2/320 |
| 527,403 | 10/1894 | Buxton | 36/134 |
| 825,869 | 7/1906 | Sandeman | 36/132 |
| 844,057 | 2/1907 | Tillinghast | 36/132 |
| 1,012,057 | 12/1911 | Brady | 36/134 |
| 1,053,506 | 2/1913 | Hersey | 36/134 |
| 1,522,022 | 12/1920 | Willson | 39/59 C |
| 1,617,418 | 2/1927 | Richardson | 36/126 |
| 1,736,576 | 11/1929 | Cable | 36/59 C |
| 1,743,285 | 1/1930 | Richardson | 36/134 |
| 1,810,577 | 6/1931 | Richardson | 36/134 |
| 2,261,785 | 5/1941 | Youmans | 36/134 |
| 2,365,027 | 12/1944 | Urbany | 39/59 C |
| 2,677,905 | 5/1954 | Dye | 36/134 |
| 2,678,507 | 5/1954 | Dye | 36/134 |
| 2,986,825 | 6/1961 | Moore | 36/126 |
| 3,040,450 | 6/1962 | Phillips | 36/126 |
| 3,063,171 | 11/1962 | Hollander | 36/134 |
| 3,271,885 | 9/1966 | McAuliffe | 36/134 |
| 3,466,763 | 12/1966 | Levin | 36/134 |
| 3,707,047 | 12/1972 | Nedwick | 36/134 |
| 4,266,349 | 5/1981 | Schmohl | 36/32 R |
| 4,347,674 | 9/1982 | George | 36/67 R |
| 4,569,142 | 2/1986 | Askinski | 36/134 |
| 4,577,422 | 3/1986 | Tanel | 36/126 |
| 4,590,693 | 5/1986 | Kawashima et al. | 36/134 |
| 4,653,206 | 3/1987 | Tanel | 36/126 |
| 4,660,304 | 4/1987 | Tanel | 36/126 |
| 4,669,204 | 6/1987 | Tanel | 36/126 |
| 4,723,365 | 2/1988 | Tanel | 36/126 |
| 4,748,752 | 6/1988 | Tanel | 36/126 |

FOREIGN PATENT DOCUMENTS

| | | | |
|---|---|---|---|
| 866767 | 2/1953 | Fed. Rep. of Germany | 36/128 |
| 1193282 | 5/1970 | United Kingdom | 36/128 |

*Primary Examiner*—Paul T. Sewell
*Assistant Examiner*—Ted Kavanaugh
*Attorney, Agent, or Firm*—Jansson & Shupe, Ltd.

[57] ABSTRACT

A cleat for an athletic shoe includes a base plate, tapered and slightly curved engagement member for penetrating the turf and a support member for coupling the engagement member to the plate. At least one notch is defined by the base plate, the support member and the engagement member for receiving bonding material to attach the cleat to a shoe sole. The comparative widths of the base plate and engagement member are such that the cleats may be arranged in a closely spaced or abutting relationships.

An athletic shoe sole includes an array of such cleats disposed along a substantially circular path to define an annular cleat array. The blade of each cleat is generally in registry with the path and the cleats thereby define an annular, substantially circular edge for facilitating pivoting movement of the sole.

12 Claims, 2 Drawing Sheets

CLEAT FOR AN ATHLETIC SHOE

FIELD OF THE INVENTION

This invention is related generally to athletic shoes of the type having cleats for penetrating ground engagement and, more specifically, to shoes with annular cleating for pivotability. Still more particularly, this invention relates to shoes with blade-like cleats of the type generally referred to as spikes and to such cleats.

BACKGROUND OF THE INVENTION

Certain athletic shoes for field sports such as baseball have a number of blade-like cleats (or "spikes") for the purpose of increasing traction. Such cleats or spikes dig into the ground to prevent slipping during starting, stopping and cutting maneuvers.

However, in addition to providing desirable traction for starting, stopping and cutting, such cleats typically provide undesirable resistance to pivoting. This can be a disadvantage in at least two ways.

First, the resistance of many prior art cleating arrangements to turning movements can create stresses within the leg when unwanted torque or force is applied to the athlete, particularly to the athlete's leg. Injuries, particularly knee and ankle injuries, can result if a twisting movement is forcibly applied to a leg at a time when the cleats are firmly planted in the turf and release is difficult or impossible.

Second, when pivoting is inhibited, maneuverability of the athlete is limited, thus making performance less than it could be. Enhancing the ability of a player to pivot while still maintaining good traction and foot stability can greatly increase effectiveness on the field.

When pivoting is inhibited, the maneuverability of the athlete is limited and performance is less than it could be. Enhancing the ability of a player to pivot while yet maintaining or improving stability and traction in foot motions not involving pivoting can greatly increase effectiveness on the field.

Pivotability is of great importance In baseball in a number of common motions. For example, pivoting is important in batting to avoid certain unnatural motions which occur because of poor pivotability, in pitching on both the lead foot and the drive foot in fielding such as in turning to make a throw.

Attention has been given to improving pivotability in cleated athletic shoes. One example of a blade-like cleat is shown in U.S. Pat. No. 4,347,674, which shows three arcuate spikes widely spaced along a circular path to facilitate pivoting. Both the configuration of such cleats, with their flat ends which are vertical (that is, perpendicular to the main sole surface), and the widely spaced arrangement of such cleats, spaced apart in fact by dimensions well in excess of spike width, are such that any resulting improvement in pivotability will not be very substantial. The configuration and spacing of such cleats is not conducive to excellent pivotability.

Such vertical ends are disadvantageous because they present a long edge for cutting the full depth of the penetrated ground during pivoting motions. This edge arrangement results in fairly high resistance to pivoting. And, the wide spacing means that fresh ground or turf is being cut for most or all of many pivoting motions.

In addition, such blade cleat has a distal edge which is generally parallel to the main sole surface along all or nearly all the width of the cleat. Such relatively long sole-parallel distal edge presents a surface which is more resistive to penetration of the ground. With such a cleat, it becomes more difficult to penetrate ground with harder surfaces, especially for players of lighter body weight.

In addition to the structural features described above, there are other structural features of prior blade-like cleats which are disadvantageous in certain situations. Some background discussion is necessary for proper understanding.

First, attention is drawn to the recent developments in athletic shoe cleating made by Michael L. Tanel, the inventor herein, involving annular cleating which provides a combination of greatly improved pivotability and excellent traction. These developments tend to reduce the chance of athletic injuries and significantly improve maneuverability on the field. Examples of such cleating are disclosed in U.S. Pat. Nos. 4,577,422, 4,653,206, 4,660,304, 4,669,204, 4,723,365 and 4,748,752.

The improvement in pivotability made possible with shoes in accordance with the principles of such patents is dramatic, and such shoes give the athletes wearing them a natural feeling of freedom together with good feeling of traction for stopping, starting and cutting.

These Tanel inventions have been commercially embodied in shoes having cleats which are integrally formed with soles and have tapered sides, rather than in spike-like cleats. One significant feature of such annular cleating arrangements is the substantially continuous nature of an annular cleat. Such a degree of continuity becomes somewhat problematic when blade-like cleating, using metal or other rigid material, is contemplated.

Blade-like cleats like those in the aforementioned U.S. Pat. No. 4,347,674 have a base plate which is attached to the blade portion of the cleat at generally right angles and which is used for securing the cleat to the sole of an athletic shoe. Attachment may be by threaded fasteners or by injection molding a bonding material over the base plate. Characteristically, such base plates of blade-like cleats of the prior art have a width which is significantly greater than the width of the blade to which they are attached. Such greater width is deemed essential to firmness of attachment to the sole, particularly when attachment is by securement by virtue of injection molding over the base plate.

However, to obtain the benefits of pivotability of substantially continuous annular cleating, and to do so without loss of sole flexibility, close spacing of discrete blade-like cleats is essential. Indeed, abutting or nearly abutting cleats is highly desirable. Such cleat "density" provides improved traction with little or no impairment of pivotability.

Unfortunately, the undue width of earlier cleat base plates rules out such close or nearly abutting arrangement of cleats. As a consequence, with such blade-like cleats of the prior art it has not been reasonably possible to construct an athletic shoe which maximizes cleat density for maximum traction. And, to merely reduce the width of the cleat bases would tend to substantially weaken the engagement of the cleat with the sole.

Another very practical consideration for athletic shoes which would have an annular arrangement of closely spaced cleats relates to the fact that athletic shoes obviously must come in a wide variety of sizes. Because of such wide variations in size, a wide variety of cleat sizes and widths could be thought to be necessary. This would complicate manufacturing and greatly increase manufacturing costs. The presence of multiple cleat sizes at the assembly station would tend to cause manufacturing errors such as selecting a cleat of improper size for a particular shoe being assembled. A universal cleat would be highly desirable.

Referring again to ease of ground penetration, consideration must also be given to the total area of the cleat edges which initially engage the turf. The greater the total area bearing on the turf, the more difficult it may be for a cleat to penetrate the ground; the smaller the total area bearing on the ground, the easier it may be for a cleat to penetrate. Reducing the blade width reduces the area of the distal ends. However, structural weakness may result from reduced cleat width and cleat deformation or breakage will likely result.

To the extent that reducing cleat width adds sharpness, there would be an increased risk of "spiking" injury. And, regardless of width, sharp corners between , the vertical sides of certain prior art cleats and their long horizontal distal edges can pose an undue- risk of injury.

Still another problem with certain cleated shoes of the prior art is that the pressure of the individual cleats can be felt by the foot of the athlete. Because of this, shoe comfort is reduced. The aforementioned annular cleats tend to overcome this problem, but for shoes with discrete blade-like cleats, this problem can be significant, particularly on hard ground.

Yet another concern with certain blade-cleated shoes of the prior art is that their low number of cleats on the forefoot provides insufficient traction during certain movements. Traction through a wide range of athletic moves is highly desirable. And, many blade-cleated shoes of the prior art have cleating arrangements which do not have sufficient spread to provide good support. In some cases, insufficient ankle stability is a result.

A few general comments are in order before turning to a description of this invention. In particular, a brief description of the foot and its pivoting and planted positions will be helpful. This can serve as an aid in understanding certain embodiments of this invention.

The sole of the foot includes four portions. These are, in order from back to front: the heel portion; the arch portion; the ball-of-the-foot portion; and the toe portion. The heel portion and the ball-of-the-foot portion are those portions which share most if not all of the player's weight when the player is in a normal standing position with feet generally flat on the ground. In such position, the arch portion and toe portion bear little if any weight.

When a player is "on his toes" in a "ready" position, virtually all of the player's weight is normally shared by the toe portion and the ball-of-the-foot portion. The same is usually true when a player is "digging" in a running action. Indeed, when a player is in the ready position, the juncture of the phalanges (toe bones) and the metatarsals is the center of weight bearing. In other words, the center of weight bearing in the forward portions of the foot actually moves forward when a player shifts to the ready position.

The sole of an athletic shoe has portions immediately below these four portions of the foot which may be designated, and herein are designated, by the same terms.

OBJECTS OF THE INVENTION

It is an object of this invention to overcome some of the problems and shortcomings of the prior art, including those mentioned above.

Another object of this invention is to provide an improved blade-like cleat.

Yet another object of this invention is to provide a blade-like cleat which facilitates mounting in an annular abutting relationship with other cleats.

Still another object of this invention is to provide a universal blade-like cleat, which may be used on a wide variety of shoe sizes.

Another object of this invention is to provide a cleat which provides improved pivotability and excellent traction.

Still another object of this invention is to provide a cleat which provides good traction characteristics upon hard ground, including hard ground covered with wet grass.

Another object of this invention is to provide a cleat which penetrates the ground well without bending or breaking.

Another object is to provide an improved athletic shoe sole of the type having blade-like cleats.

Another object of this invention is to provide an athletic shoe having both improved pivotability and excellent traction.

Another object of this invention is to provide an improved athletic shoe which tends to reduce the risk of certain common injuries of athletes, particularly knee and ankle injuries.

Another object is to provide an improved athletic shoe of the type having annular cleating.

Another object of this invention is to provide an improved annular-cleated athletic shoe with enhanced ground penetration.

Another object of this invention is to provide a blade-cleated athletic shoe which reduces the possibility of ankle injuries.

Another object of this invention is to provide improved ground penetration in an annular-cleated shoe without the need to sharpen the distal edge of annular cleating.

Yet another object of this invention is to provide a cleated athletic shoe exhibiting excellent sole comfort.

These and other important objects will be apparent from the descriptions of this invention which follow.

SUMMARY OF THE INVENTION

This invention is an improved blade-like cleat for athletic shoe soles and an improved athletic shoe for field sports. The invention provides excellent controlled pivotability and traction in a commercially desirable form particularly useful for baseball and the like.

A plurality of the improved blade-like cleats of this invention are disposed on a substantially circular path to permit easy pivoting movement. The cleats are mounted in an abutting or substantially abutting (closely spaced) relationship, such that they together form what is essentially an annular circular edge. Such array of cleats provides excellent penetration and pivoting characteristics without compromising traction.

The configuration of the blade-like cleat of this invention allows mounting to a sole in such abutting arrangement. The inventive cleat firmly engages the sole despite its abutting relationship to adjacent cleats. And the configuration is such that a single cleat configuration allows formation of an annular array for shoes of a wide variety of sizes.

The cleat of this invention includes a base plate with an outer segment having a first width and a tongue for attachment of the cleat to a shoe sole by embedding it in the material forming the sole. A blade is attached to the base plate and extends generally perpendicularly from it. The blade has an engagement member for providing traction on the ground and a support member for coupling the engagement member to the plate. The cleat is preferably integrally formed, with all of the aforementioned "members" thereof being portions of one piece.

The engagement member includes a lower shoulder and an upper tip, the latter to initially engage and penetrate the surface of an athletic field. The support member has a second width which is less than the first width, thereby forming a notch between the engagement member and the base plate. Bonding material may be received in the notch and over the base plate for attaching the cleat to the sole of an athletic shoe.

In a highly preferred cleat, the engagement member will have generally straight edges which are angularly arranged. These edges extend between the extremities of the lower shoulder and the corresponding extremities of the upper tip. The shape of the engagement member thereby resembles that of a truncated isosceles triangle.

In a preferred embodiment, the outer segment or edge of the base plate has a width which is generally equal to the width of the lower shoulder of the engagement member. In any event, the width of the outer segment need be no greater than that of the lower shoulder. This permits mounting of cleats in a relationship whereby the lower shoulder extremities of adjacent cleats may be closely spaced one to another or may actually abut.

It is also preferred that the engagement member be joined to the base plate by a support member. This support member is preferably centered generally midway between the extremities of the lower shoulder and the outer segment and has a width which is significantly less than either of the foregoing. When constructed in that fashion, the lower shoulder, the support member and the base plate cooperate to define a notch at either side of the cleat. This notch is used to receive bonding materials such as injection molded nylon or polyurethane used to attach the cleat to the sole of a shoe, or to form the sole around such cleat base.

The inventive cleats may be arranged in a wide of variety of patterns upon the sole of a shoe. However, for the athletic shoe of this invention with its annular array of cleats, a plurality of cleats project from the sole and are disposed along a substantially circular path. This path encompasses a major area of the ball-of-the-foot and toe portions The unique structure of the cleats permits them to be arranged in an abutting or nearly abutting relationship to each other, in end-to-end fashion. This arrangement forms what may be described as an annular cleat which provides improved engagement between the shoe sole and the surface of the turf.

In a highly preferred embodiment, the engagement member is slightly curved (arcuate) to facilitate pivoting movement. When the cleat functions as a universal cleat, suitable for shoes of all sizes, its curvature is set to follow a perfect circle for a shoe of mid-range size. Thus, if the cleat will be used on shoes from sizes 7 to 16, the curvature for a size 11 or 12 cleat will be used. It has been determined that such curvature is fully acceptable for annular arrays throughout the entire size range. While spacing between cleats will vary slightly, such universal cleat will essentially follow the circles of all such sizes.

When constructed as described, the inventive cleat has a distal edge which presents a relatively small area to the surface of the ground. This enhances ease of ground penetration. In addition, the cleat has edges which angularly cut through the turf after initial penetration. This configuration accomplishes two highly desirable results.

First, resistance to initial penetration is low and increases gradually rather than instantaneously as the cleat penetration depth increases. Second, as the shoe is pivoted the angularly arranged edges of the engagement member will slice through and penetrate turf more readily than the vertical edges of earlier blade-like cleats. And, because of the close spacing made possible by the cleat of this invention, pivoting rotation causes a trailing cleat to promptly enter and follow a path cut by a leading cleat, with only the most minimal initial pivoting necessary to start such following process. Because of the tapered edges, as pivoting progresses through such initial stages, there is a continuous reduction in resistance to pivoting movement.

While it may be recognized that traction is increased by increasing the number of blade-like cleats on the forward portion of a sole (sometimes referred to as cleat "density"), other facters will be important. For example, an athlete needs excellent sole flexibility, particularly in the ball-of-the-foot portion. Therefore, it is preferred that the annular cleat arrangement be such as can promote flexibility, while yet maintaining excellent capability for stopping, starting and cutting.

When mounted in an abutting relationship, adjacent pairs of the tapered cleats define generally V-shaped spaces. Sole flexibility is enhanced by positioning cleats so that opposed pairs of such spaces form a plurality of cross-sole breaks (for example, two) in the annular cleat array. Such breaks are preferably near the juncture of the ball-of-the-foot and toe portions of the sole and between the ball-of-the-foot and arch portions.

The configuration of the inventive cleat may be readily adapted to accommodate specific requirements. For example, the angles of taper may be changed, the degree of sharpness of the angled edges and/or the distal edge may be modified and the projecting length of the cleat may be changed.

The annular array of blade-like cleats of this invention provides a wide base of cleat engagement, which tends to reduce the possibility of ankle injuries. The soles of this invention are also comfortable to wear, substantially avoiding any feeling of individual cleats as can occur with certain shoes of the prior art.

DETAILED DESCRIPTIONS OF PREFERRED EMBODIMENTS

Figure 1:
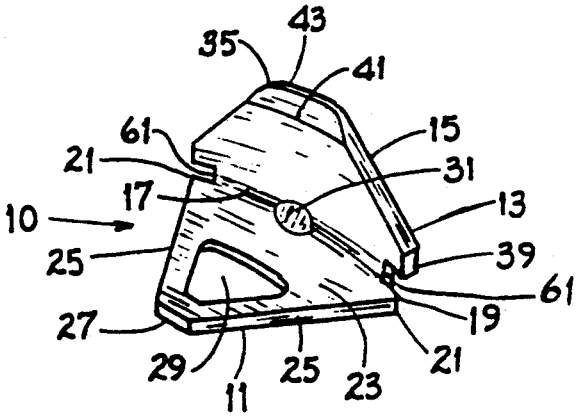
FIG. 1 is a perspective view of the inventive cleat.
Figure 2:
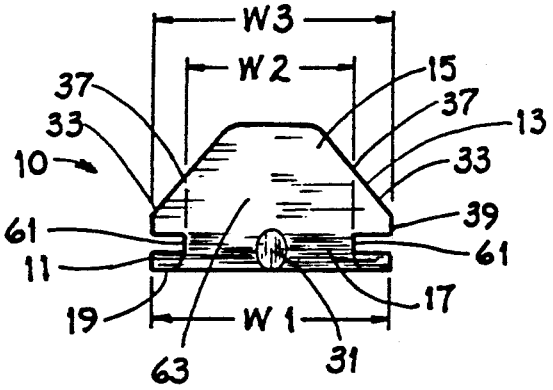
FIG. 2 is an elevation view of the cleat of FIG. 1 taken along the viewing axis 2 thereof.

Referring to FIGS. 1 and 2, a universal cleat 10 for an athletic shoe includes a base plate 11 and a blade 13 attached to the plate 11 and extending generally normally therefrom. The blade 13 includes an engagement member 15 for providing traction upon an athletic field and a support member 17 for joining the engagement member 15 to the plate 11. The base plate 11 has an outer segment 19 with a curved profile terminating in base extremities 21. An inwardly extending tongue 23 is provided to attach the cleat 10 to the sole, is defined by generally straight edges 25 and terminates in a blunted tip 27. To further facilitate attachment of cleat 10, tongue 23 also includes an aperture 29 which may be of any convenient shape, triangular for example. A way to attach cleat 10 to the sole is described following.

A support member 17 is joined to tongue 23 adjacent outer segment 19 and extends upward to support engagement member 15. One preferred way to form inventive cleat 10 is by stamping and bending and if so formed, support member 17 will exhibit a slight bending radius. To help provide additional rigidity, a small convex dimple 31 is formed in support member 17; in some cases, two or more dimples may be desirable. In a highly preferred embodiment, engagement member 15 tapers upwardly and includes a relatively wide lower shoulder 33 and a relatively narrow upper tip 35. Generally straight edges 37 extend between the extremities 39 of lower shoulder 33 and the corresponding extremities of upper tip 35 so that the shape of engagement member 15 resembles that of a truncated isosceles triangle. However, it is to be appreciated that the angles included between either of the edges 37 and upper tip 35 need not be equal one to the other. Special situations may suggest an engagement member 15 which is tapered to define geometric shapes other than an isosceles triangle.

As described above, conflicts arise from the configuration of a conventional blade-like cleat and these were unresolved prior to inventive cleat 10. That is, it was desirable to have the distal ends of cleats present a total area which was relatively small for initial engagement of the earth. Inconsistently, the cleat was required to have a width which was sufficient to provide acceptable mechanical rigidity against bending forces and to provide resistance against slipping. The inventive cleat 10 resolves these conflicts in that a relatively small tip 35 area is presented for initial turf engagement and penetration. However the overall broad-shouldered structure of blade 13 is sufficiently robust to resist bending and breakage.

Figure 3:
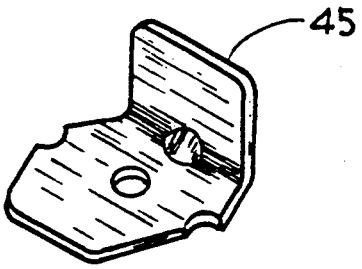
Fig. 3 PRIOR ART
FIG. 3 is a perspective view of a prior art cleat.

The ease with which tip 35 initially penetrates the turf may be further improved by the inclusion of a bevel surface 41, thereby further diminishing the area of the distal end 43. It is also to be appreciated that unlike an earlier cleat 45 as shown in FIG. 3, inventive cleat 10 has a distal end 43 which is devoid of 90° corners. The absence of such sharp corners may help avoid laceration injuries which commonly occur in baseball.

Figure 4:
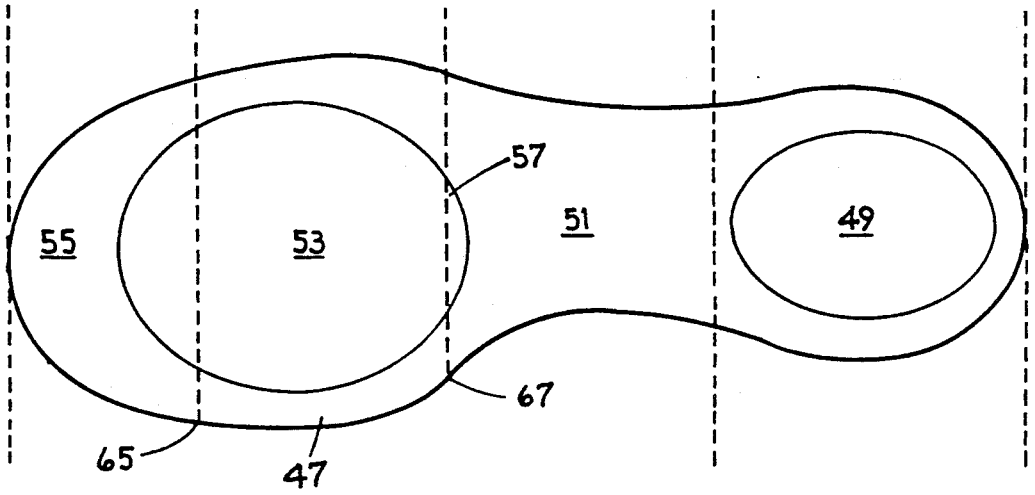
FIG. 4 is a bottom plan view of an athletic shoe sole, devoid of cleats, illustrating the portions thereof.

Before describing other benefits arising from the use of inventive cleat 10, reference is made to FIG. 4 which depicts the sole 47 of an athletic shoe devoid of cleats. The sole 47 has four portions which are defined by the portions for the foot adjacent to them. These sole portions are: a heel portion 49, immediately below the player's heel; an arch portion 51, below the arch of the player's foot; a ball-of-the-foot portion 53, below the ball of the player's foot; and toe portion 55, below the player's toes.

As previously noted, the ball-of-the-foot and the heel portions, 53, 49 respectively, bear weight when the player is in a flat footed stance while the toe and the ball-of-the-foot portions 55, 53 respectively, bear weight when the player is in the ready position. For some sports and/or particular types of playing fields, it may be desirable for a shoe to exhibit very high tractive capabilities. One approach to this capability is by increasing the number of cleats 10, i.e., the cleat "density". Concurrently, the player must be able to quickly and easily pivot the shoe without undue leg and knee strain.

Figure 5:
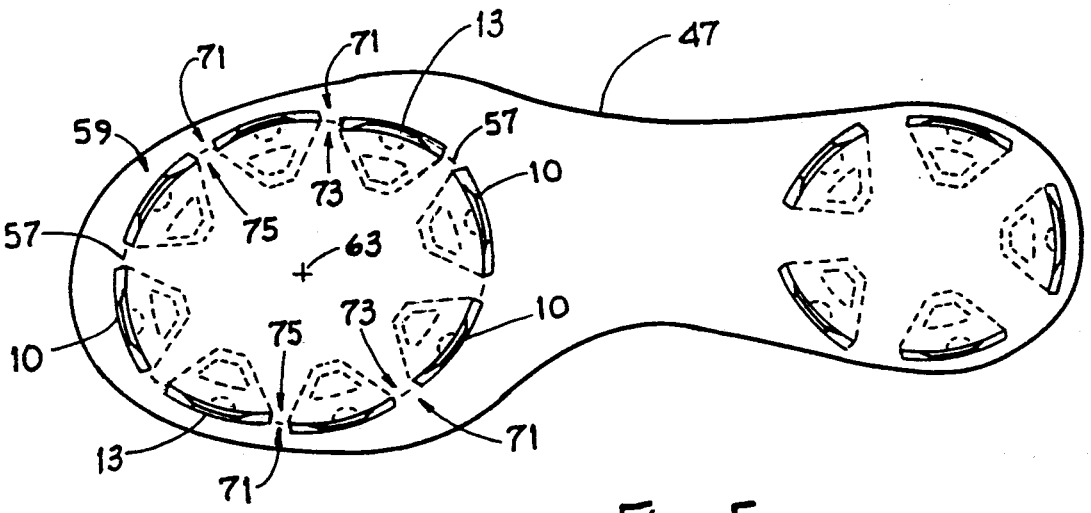
FIG. 5 is a bottom plan view of an athletic shoe sole in accordance with this invention, having an array of the cleats of this invention.

Referring additionally to FIG. 5, these two objectives may be accomplished by arranging cleats 10 along a substantially circular path 57 which encompasses a major area of the ball-of-the-foot and toe portions 53, 55 respectively. Each cleat 10 is arranged so that blade 13 is generally in registry with the path 57 and so that cleats 10 are in a closely spaced or substantially abutting relationship to at least one adjacent cleat 10. This arrangement forms what may be described as an annular cleat array 59 which extends along a substantially circular path 57 and encompasses a major area of the ball-of-the-foot and toe portions 53, 55 respectively. This array 59 provides improved engagement between the shoe sole 47 and the surface of the turf while yet readily permitting pivoting movement.

Referring again to FIGS. 1 and 2, arrangement of cleats 10 in a closely spaced or abutting relationship is facilitated by dimensional features of cleat 10. The distance between extremities 21 of outer segment 19 is selected to have a width W1. The width of support member 17 is selected to have a width W2 which is less than W1 and the extremities 39 of the lower shoulder 33 are selected to have a width W3 therebetween. In a preferred embodiment, the width W2 will be less than width W1 while the width W3 will be at least as great as W1. In a highly preferred embodiment, the width W1 and W3 will be generally equal one to the other. When so constructed, outer segment 19, support member 17 and lower shoulder 33 will cooperate to define at least one notch 61 therebetween. If, for example, a vertical edge of support member 17 is aligned with the corresponding extremities 39, 21 of lower shoulder 33 and outer segment 19 respectively and if the described dimensional relationships are adhered to, cleat 10 will include only one such notch 61. However, in a highly preferred embodiment, the support member 17 will be generally centered between the extremities 21, 39 of the outer segment 19 and the, lower shoulder 33 and the cleat 10 will have two notches 61 as shown in FIGS. 1 and 2. When so formed, the extremities 39 of the lower shoulder 33 will be in a vertically spaced but otherwise generally coterminal relationship to the corresponding extremities 21 of the outer segment 19.

If the width W3 is no less than the width W1 (and assuming that the width W2 is less than either) cleats 10 may be mounted to be closely spaced or so that the lower shoulders 33 of adjacent cleats 10 are in an abutting relationship. Even when so mounted, cleats 10 will nevertheless lend themselves to attachment to sole 47 by bonding. When so attached, the bonding material is placed to cover base plate 11 and extend outward through notches 61 to adhere to sole 47 in regions exterior to circular path 57. This material will also flow into the aperture 29 and bond to the sole 47, thus further securing cleat 10.

When attaching cleat 10 to the sole 47, it is preferred that the sole 47 be formed with shallow cavities having a shape conforming to the perimeter outline of the base plate 11 and a depth generally equal to its thickness. The base plate 11 of a cleat 10 is placed into each cavity prior to application of the bonding material.

To simplify the manufacturing function, it is preferred that cleat 10 be formed to be useful on shoe sizes ranging from about size 7 through about size 15. Accordingly, a highly preferred embodiment of cleat 10 will include an engagement member 15 having a curved surface 63 and an outer segment 19 which is similarly curved. The curved edge of the outer segment 19 of the base plate 11 will be substantially coincident with a projected extension of the engagement member 15.

Referring to FIG. 5, the radius selected when forming these parts 15, 19 is generally equal to the distance from a central point 63 to circular path 57 on a mid-range shoe size, nominally a size 11 shoe. In addition, the width W3 is selected in such a way that cleats 10 arranged in abutting relationship on the smallest shoe, size 7, will define an acceptably smooth ring when cleats 10 are arranged in a generally circular path 57.

When using the inventive cleat 10, it is preferred that the sole 47 of the shoe exhibit a high degree of flexibility, particularly in those regions adjacent the junction 65, 67 respectively of toe and ball-of-the-foot portions 55, 53 and adjacent the ball-of-the-foot and the arch portions 53, 51. It will be noted that each adjacent pair of cleats 10 defines a generally V-shaped space 71 between them. To attain the desired flexibility, the cleats 10 are arranged so that a first opposed pair 73 of V-shaped spaces 71 defines a break located adjacent the junction 67 of the arch portion 51 and the ball-of-the-foot portion 53. Similarly, a second opposed pair 75 of V-shaped spaces 75 defines a break located adjacent the junction 65 of the ball-of-the-foot portion 53 and the toe portion 55. The flexibility of the sole is thereby preserved. It is to be understood that the V-shaped spaces 71 referred to are defined by edges 37 of adjacent cleats 10 as would be seen in a side elevation view of the sole of FIG. 5.

From the foregoing, it will be understood that cleat 10 may be used in a number of patterns and for a wide range of shoe sizes. This minimizes tooling costs and for a given number of shoes to be fitted with cleats 10 it will greatly increase the quantity of cleats 10 to be purchased or manufactured. This will have very favorable implications for the unit cost of each cleat 10.

In addition, inventory management will be greatly simplified in that the same cleat 10 may be used to assemble practically all sizes of shoes. This helps avoid the necessity of segregating cleat sizes. In addition, it dramatically reduces the chance of error on the part of a shoe assembler who may otherwise use a cleat 10 of the incorrect size.

Yet another benefit is that the inventive cleat 10 lends itself well to field replacement. A player or athletic department wishing to effect cleat replacement need only order a single cleat size.

Another benefit of inventive cleat 10 is that the weight of the shoe may be reduced by fabricating cleat 10 of aluminum or plastic rather than of steel. When formed of aluminum, cleat 10 may also be colored by anodizing and this may provide certain marketing advantages. Weight reduction may be especially important when a relatively large numbers of cleats 10 are used on a shoe. In some cases, it may be desirable to have, on a single shoe, cleats of different materials; for example, cleats in positions receiving more stress may be of one material, while cleats in less-stressed positions may be of another.

While the principles of this invention have been described in connection with specific embodiments, it should be understood clearly that these descriptions are made only by way of example and are not intended to limit the scope of the invention.

I claim:

1. In a blade-like individual cleat for an athletic shoe of the integral angled-plate type, the improvement comprising:

a base plate for attachment to an athletic shoe sole, the base plate including an outer portion with base extremities of first width and a tongue portion extending from the outer portion;

a base substantially normal to the base plate, the blade including a ground-engagement portion extending to a blade distal end and further including a support portion joining the ground-engagement portion to the base plate;

the ground-engagement portion having opposed diverging edges extending from the blade distal end to shoulder extremities near the support portion; and the support portion having a width less than the first width to form a notch between the shoulder extremities and the base plate, the shoulder extremities being vertically spaced from the aligned with the base extremities, thereby to facilitate cleat attachment to the sole, whereby, when attached to the athletic shoe sole with a plurality of similar individual cleats arranged such that their ground-engagement portions extend along a circle, said cleat provides improved angular turf cutting and pivotability for said shoe.

2. The cleat of claim 1 wherein the blade distal end has a distal end edge having a width less than the width of the shoulder extremities.

3. The cleat of claim 2, wherein the ground-engagement portion of the blade forms a truncated isosceles triangle, thereby to provide further improved bidirectional pivotability.

4. The cleat of claim 2 wherein the distal end edge is beveled for easier penetration of the ground.

5. The cleat of claim 1 wherein the support portion is substantially centered between the shoulder extremities, thereby to form a pair of said notches at opposite ends of the support portion.

6. The cleat of claim 1 wherein the ground-engagement portion is arcuate.

7. The cleat of claim 6 wherein the outer portion of the base plate is arcuate and substantially coincident with an extension of the arcuate ground-engagement portion.

8. The cleat of claim 1 wherein the tongue portion includes an aperture for receiving the material, thereby aiding attachment of the cleat to the sole.

9. The cleat of claim 1 wherein the base plate and blade are integrally formed and wherein a dimple is formed in the cleat at the junction of the base plate and blade, thereby to provide added resistance against cleat-bending forces.

10. A blade-like individual cleat for an athletic shoe comprising:

a base plate for attachment to an athletic shoe sole, the base plate including an outer portion of first width and a tongue portion which extends therefrom to a tongue distal end which is narrower than the first width, said tongue portion being tapered along substantially its entire length;

a blade substantially normal to the base plate, the blade including a ground-engagement portion extending to a blade distal end and further including a support portion joining the ground-engagement portion to the base plate;

the ground-engagement portion having opposed diverging edges extending from the blade distal end to shoulder extremities near the support portion; and the support portion having a width less than the first width to form a notch between the shoulder extremities and the base plate, thereby to facilitate cleat attachment to the sole;

whereby, when attached to the athletic shoe sole with a plurality of similar individual cleats arranged such that their ground-engagement portions extend along a circle, said cleat provides improved angular turf cutting and pivotability for said shoe.

11. The cleat of claim 10 wherein the tongue portion has opposed tongue edges which converge toward the tongue distal end.

12. In a blade-like individual cleat for an athletic shoe of the integral angled-plate type, the improvement comprising:

base plate for attachment to an athletic shoe sole, the base plate including an outer portion with base extremities of first width and a tongue portion extending from the outer portion to a terminal end, all of said tongue portion configured to be coplanar with the sole;

a blade substantially normal to the base plate, the blade including a ground-engagement portion extending to a blade distal end and further including a support portion joining the ground-engagement portion to the base plate; and the support portion having a width less than the first width to form a substantially unobstructed notch between the ground-engagement portion and the base plate, the shoulder extremities being vertically spaced from and aligned with the base extremities.

whereby the individual cleat may be more securely attached to the sole.

* * * * *

UNITED STATES PATENT AND TRADEMARK OFFICE

CERTIFICATE OF CORRECTION

PATENT NO. : 5,058,292

DATED : October 22, 1991

INVENTOR(S) : Michael L. Tanel

It is certified that error appears in the above-identified patent and that said Letters Patent is hereby corrected as shown below:

In column 1, line 41, change "importance In" to --importance in--.

In column 1, line 45, insert a --,-- after "drive foot".

In column 3, line 17, delete the "," after "between".

In column 3, line 19, change "undue-" to --undue--.

In column 8, line 45, delete the "," after "the".

In column 9, line 30, change "75" to --71--.

Column 10:
In claim 1, line 8, delete the first instance of "base" and insert --blade-- in its place.

In claim 1, line 20, delete "the" and insert --and-- in its place.

Column 12:
In claim 12, line 4, insert --a-- before "base".

Signed and Sealed this

Second Day of March, 1993

*Attest:*

STEPHEN G. KUNIN

*Attesting Officer*

*Acting Commissioner of Patents and Trademarks*